US011779941B2

(12) United States Patent
Hao et al.

(10) Patent No.: US 11,779,941 B2
(45) Date of Patent: Oct. 10, 2023

(54) SEALING VALVE, AND LIQUID OUTLET STRUCTURE COMPRISING SAME

(71) Applicant: Shijiazhuang Hipro Biotechnology Co., Ltd., Shijiazhuang (CN)

(72) Inventors: Shushun Hao, Shijiazhuang (CN); Yanjun Sui, Shijiazhuang (CN); Lizhu Chen, Shijiazhuang (CN); Shiyuan Xing, Shijiazhuang (CN); Zhaohui Yao, Shijiazhuang (CN)

(73) Assignee: Shijiazhuang Hipro Biotechnology Co., Ltd., Shijiazhuang (CN)

( * ) Notice: Subject to any disclaimer, the term of this patent is extended or adjusted under 35 U.S.C. 154(b) by 0 days.

(21) Appl. No.: 18/198,825

(22) Filed: May 17, 2023

(65) Prior Publication Data

US 2023/0285994 A1 Sep. 14, 2023

Related U.S. Application Data

(63) Continuation of application No. PCT/CN2021/117654, filed on Sep. 10, 2021.

(30) Foreign Application Priority Data

Nov. 23, 2020 (CN) ..... 202011317080.5

(51) Int. Cl.

| | |
|---|---|
| ***B05B 1/30*** | (2006.01) |
| ***B05B 15/65*** | (2018.01) |
| ***B01L 3/00*** | (2006.01) |

(52) U.S. Cl.

CPC ..... *B05B 1/3013* (2013.01); *B01L 3/52* (2013.01); *B05B 15/65* (2018.02); *B01L 2400/0478* (2013.01); *B01L 2400/0622* (2013.01)

(58) Field of Classification Search

CPC ..... B05B 1/3013; B05B 15/65; B01L 3/52; B01L 2400/0478; B01L 2400/0622

USPC ..... 239/583, 584, 585.1, 585.5

See application file for complete search history.

(56) References Cited

U.S. PATENT DOCUMENTS

| | | | | |
|---|---|---|---|---|
| 5,772,122 | A * | 6/1998 | Sugiura | F02M 69/047 239/585.1 |
| 6,027,050 | A * | 2/2000 | Rembold | F02M 61/162 239/585.5 |
| 2016/0263594 | A1 | 9/2016 | MacIndoe | |
| 2018/0022537 | A1 | 1/2018 | Plaschkes et al. | |

FOREIGN PATENT DOCUMENTS

| | | | |
|---|---|---|---|
| CN | 102072327 | A | 5/2011 |
| CN | 104169008 | A | 11/2014 |
| CN | 110325772 | A | 10/2019 |
| WO | 9418011 | A1 | 8/1994 |

* cited by examiner

*Primary Examiner* — Steven J Ganey
(74) *Attorney, Agent, or Firm* — AP3 Law Firm PLLC

(57) ABSTRACT

A sealing valve comprises a sealing valve body (1). The sealing valve body (1) is provided with a cylindrical valve hole (2), and a bottom end of the cylindrical valve hole (2) is provided with a frustum hole (3). The frustum hole (3) is arranged coaxially with the cylindrical valve hole (2), and a small bottom end of the frustum hole (3) is in communication with the bottom end of the cylindrical valve hole (2). The sealing valve is controllable over the opening and closing of a nozzle.

12 Claims, 4 Drawing Sheets

SEALING VALVE, AND LIQUID OUTLET STRUCTURE COMPRISING SAME

CROSS-REFERENCE TO RELATED APPLICATIONS

This application is a continuation of International Application No. PCT/CN2021/117654, filed on Sep. 10, 2021, which claims priority to Chinese Patent Application No. 202011317080.5, filed on Nov. 23, 2020. The disclosures of the aforementioned applications are hereby incorporated by reference in their entireties.

TECHNICAL FIELD

The disclosure relates to the technical field of liquid outlet structure of reagent kits, and in particular, to a sealing valve, and a liquid outlet structure comprising same.

BACKGROUND

Kits are common laboratory supplies used to preserve reaction reagents. In the prior art, in a laboratory, pipettes or syringes are required to draw the reagents out the kits before injecting the reagents into an experimental instrument. When drawing different reagents, it is required to replace the pipette tip or clean the syringe and the needle of the syringe, which is cumbersome and time-consuming. And, the amount of reagent drawn out is easily affected by the operator's operation method, which is not conducive to conversion to automated instruments for operation.

SUMMARY

These and other problems are generally solved or circumvented, and technical advantages are generally achieved, by embodiments of the present disclosure which provide a sealing valve, and a liquid outlet structure comprising same.

Technical Problems

The purpose of this application is to provide a sealing valve that can control the opening and closing of the nozzle easily and has good sealing performance, and can prevent liquid crystallization at the nozzle. At the same time, it provides a liquid outlet structure that is simple and compact, can take liquid accurately and realize automation easily.

Technical Solutions

This application adopts the following technical solution: the first aspect, a sealing valve includes a sealing valve body. The sealing valve body is provided with a cylindrical valve hole and a bottom end of the cylindrical valve hole is provided with a frustum hole. The frustum hole is arranged coaxially with the cylindrical valve hole, and a first bottom end of the frustum hole is in communication with the bottom end of the cylindrical valve hole.

In one of the embodiments, the sealing valve further includes a cylindrical liquid storage tank communicable with a second bottom end of the frustum hole. The cylindrical liquid storage tank is arranged coaxially with the frustum hole, and a diameter of the cylindrical liquid storage tank is greater than a diameter of the second bottom end of the frustum hole.

In one of the embodiments, the sealing valve further includes a sealing groove provided at a top end of the cylindrical valve hole, and a connection between the sealing groove and a top end of the sealing valve body is transited via an arc surface.

In one of the embodiments, a shape of the sealing valve body is cylindrical.

The upper and lower end surfaces of the sealing valve are closely matched with the spray pipe and nozzle respectively, which is conducive to sealing performance.

The second aspect, a liquid outlet structure including the sealing valve mentioned above includes a spray pipe and a nozzle provided at an end portion of the spray pipe.

The spray pipe includes a spray pipe body, a spray hole formed in an axial direction of the spray pipe body, and a magnet bar provided in the spray hole. A plurality of blocking strips extending axially along the spray hole are uniformly arranged on an inner wall of the spray hole, and one end of each of the plurality of blocking strips is provided with a shoulder that extends towards a center of the spray hole. The magnet bar moves along an axial direction of the spray hole in a space defined by a plurality of shoulders and the plurality of blocking strips.

The nozzle includes an annular sleeve, an end plate provided at one end of the annular sleeve, a nozzle pipe provided at a center of the end plate, and a conical nozzle opening provided at an end portion of the nozzle pipe. An annular blocking flange surrounding a periphery of the nozzle pipe is further provided at the end plate. A liquid channel communicable with an interior of the annular sleeve is formed in the nozzle pipe and the conical nozzle opening. An annular groove is defined between the nozzle pipe and the annular blocking flange.

The annular sleeve is in threaded connection or clamped connection with the spray pipe body and the sealing valve is provided in the annular sleeve.

In one of the embodiments, the spray pipe body is provided with a first end close to the plurality of shoulders, and an outer side wall of the first end is provided with an external thread, and an opening end of the annular sleeve is provided with an internal thread matching the external thread.

In one of the embodiments, the spray pipe body is provided with a second end away from the plurality of shoulders, and the second end is provided with an annular connecting part. An outer side wall of the annular connecting part is provided with an annular convex, and an opening end of the annular sleeve is provided with an annular concave matching the annular convex.

In one of the embodiments, a shape of the magnet bar is cylindrical.

In one of the embodiments, a quantity of the plurality of blocking strips is at least three.

In one of the embodiments, a circular section diameter defined by the plurality of shoulders is smaller than a section diameter of the magnet bar, and a circular section diameter defined by the plurality of blocking strips is greater than the section diameter of the magnet bar.

Advantageous Effects of the Disclosure

The cylindrical valve hole in the sealing valve body of this disclosure is used for passing liquid, and the sealing groove at the top end of the cylindrical valve hole can contain a magnet bar, which is conducive to sealing the cylindrical valve hole. The frustum hole and cylindrical liquid storage tank at the bottom end of the cylindrical valve hole can store a portion of liquid that is used for soaking the conical nozzle opening and preventing the liquid inside the nozzle from rapidly evaporating and crystallizing. The nozzle and spray pipe are sealed by the sealing valve to prevent air leakage at the connection between the nozzle and spray pipe.

The spray pipe is in clamped connection or threaded connection with the nozzle, which facilitates disassembly and replacement.

The shoulders in the spray hole of the spray pipe body are used to prevent the magnet bar from blocking the liquid inlet end, and a gap is formed between adjacent blocking strips for liquid flow. When the liquid flows along the gaps, it will not be blocked by the magnet bar. When the magnet bar moves to the other end, it can block the nozzle at the end portion of the spray pipe. The reciprocating movement of the magnet bar in the spray hole realizes the opening and closing of the spray pipe.

The conical nozzle opening of the nozzle is designed as a conical surface, which can prevent liquid from adhering to the lower end of the nozzle forming hanging droplets. The annular blocking flange and annular groove around the nozzle pipe can prevent the slender nozzle pipe from being damaged by external forces. The annular groove can also clamp the sealing cover of a container when installing the container for receiving liquid reagents flowing out of the nozzle to prevent the sealing cover from being disengaged easily. It is easy for the liquid outlet structure provided in this disclosure to be installed and has good liquid outlet effect.

The structure of the device provided in this disclosure is ingenious and simple, which is conducive to achieving automation and miniaturization.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

Figure 1:
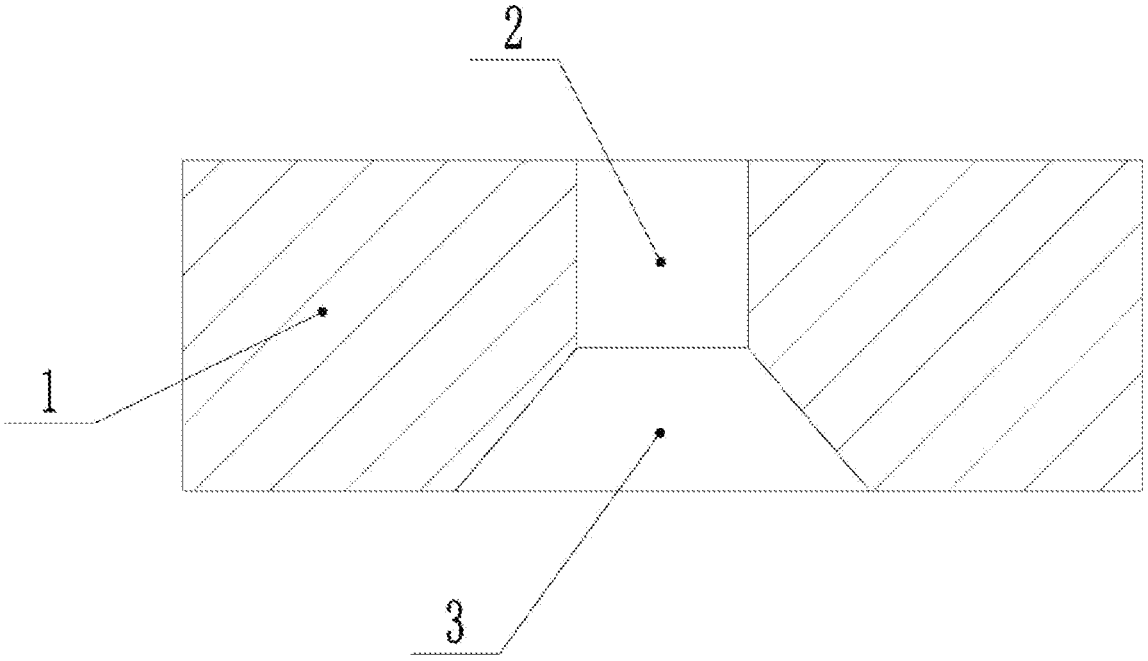
FIG. 1 is a schematic sectional view of the sealing valve in embodiment 1.

In the following description, a clear and complete description of the technical solution in the embodiments of this application will be provided referring to the drawings. It should be appreciated, however, that the concepts disclosed herein can be embodied in a wide variety of specific contexts. The specific embodiments discussed are merely illustrative, and do not limit the scope of the claims.

Embodiment 1

As shown in FIG. 1, a sealing valve includes a sealing valve body 1. The sealing valve body 1 is provided with a cylindrical valve hole 2 and a bottom end of the cylindrical valve hole 2 is provided with a frustum hole 3. The frustum hole 3 is arranged coaxially with the cylindrical valve hole 2, and a first bottom end of the frustum hole 3 is in communication with the bottom end of the cylindrical valve hole 2. A shape of the sealing valve body 1 is cylindrical. The material of the sealing valve body 1 is selected from an elastic material, such as rubber, preferably silica gel. The frustum hole 3 is provided with a first bottom end and a second bottom end, and a diameter of the second bottom end of the frustum hole 3 is greater than that of the first bottom end of the frustum hole 3.

Embodiment 2

Figure 2:
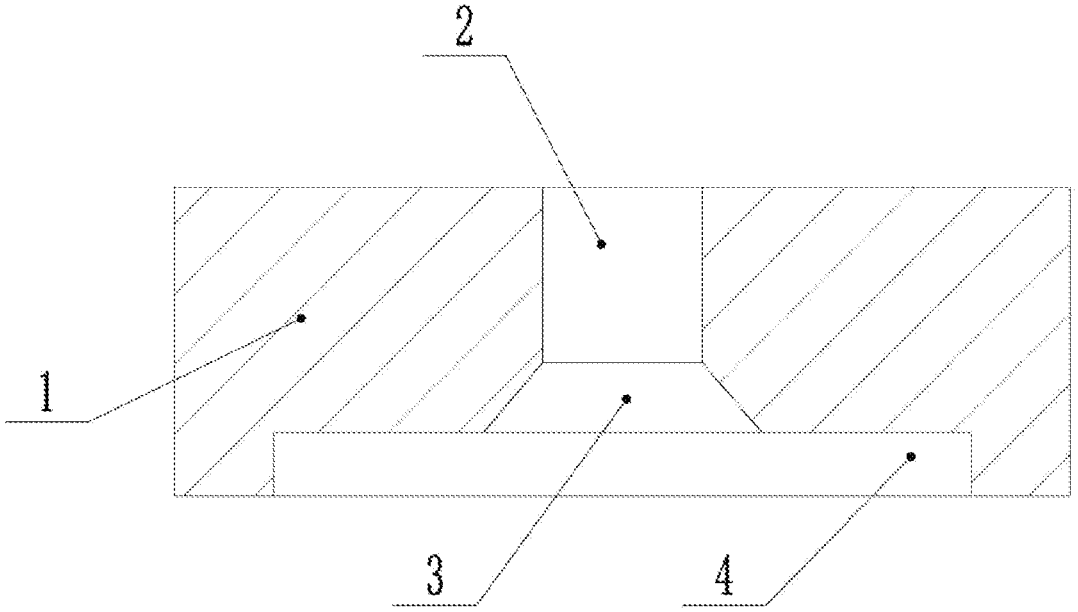
FIG. 2 is a schematic sectional view of the sealing valve in embodiment 2.

The sealing valve provided in embodiment 2 differs from embodiment 1 in that: in embodiment 2 as shown in FIG. 2, the sealing valve further includes a cylindrical liquid storage tank 4 communicable with the second bottom end of the frustum hole 3. The cylindrical liquid storage tank 4 is arranged coaxially with the frustum hole 3, and a diameter of the cylindrical liquid storage tank 4 is greater than a diameter of the second bottom end of the frustum hole 3.

Embodiment 3

Figure 3:
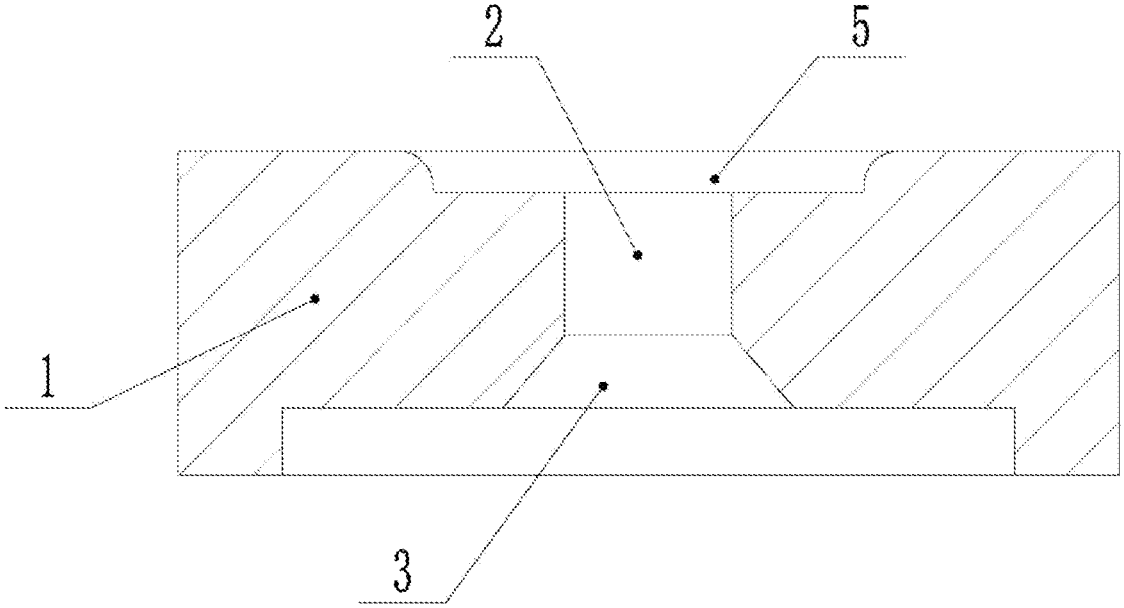
FIG. 3 is a schematic sectional view of the sealing valve in embodiment 3.

The sealing valve provided in embodiment 3 differs from embodiment 1 or embodiment 2 in that: in embodiment 3 as shown in FIG. 3, the sealing valve further includes a sealing groove 5 provided at a top end of the cylindrical valve hole 2, and the connection between the sealing groove 5 and a top end of the sealing valve body 1 is transited via an arc surface, that is, the inner side wall of the sealing groove 5 is in a circular arc shape.

Embodiment 4

Figure 4:
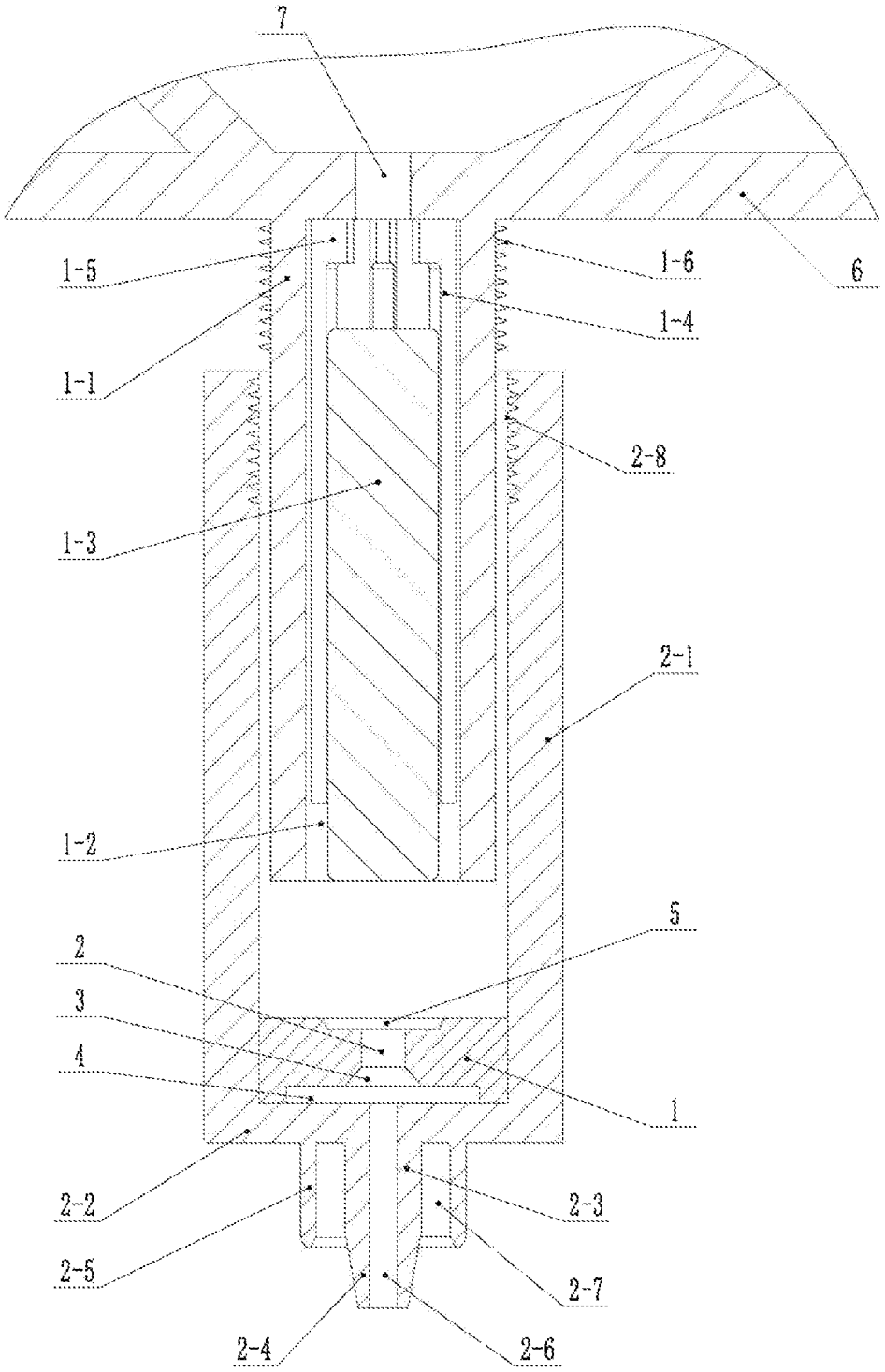
FIG. 4 is a schematic sectional view of the liquid outlet structure in embodiment 4.

As shown in FIG. 4, a liquid outlet structure includes a spray pipe and a nozzle provided at an end portion of the spray pipe.

The spray pipe includes a spray pipe body 1-1, a spray hole 1-2 formed in an axial direction of the spray pipe body 1-1, and a magnet bar 1-3 provided in the spray hole 1-2. A plurality of blocking strips 1-4 extending axially along the spray hole 1-2 are uniformly arranged on an inner wall of the spray hole 1-2, and one end of each of the plurality of blocking strips 1-4 is provided with a shoulder 1-5 that extends towards a center of the spray hole 1-2. The magnet bar 1-3 moves along an axial direction of the spray hole 1-2 in a space defined by a plurality of shoulders 1-5 and the plurality of blocking strips 1-4.

The spray pipe body 1-1 is fixedly connected to the kit 6, and the spray hole 1-2 in the spray pipe body 1-1 is in communication with a liquid outlet hole 7 of the kit 6. One end of the spray pipe body 1-1 close to the shoulder 1-5 is a liquid inlet end, and the liquid reagent in the kit 6 flows into the spray hole 1-2 of the spray pipe body 1-1 from the liquid inlet end.

The circular section diameter defined by the plurality of shoulders 1-5 is smaller than the section diameter of the magnet bar 1-3, and the circular section diameter defined by the plurality of blocking strips 1-4 is greater than the section diameter of the magnet bar 1-3. Specifically, a first cylindrical space with a horizontal cross-section is defined by the plurality of shoulders 1-5. Similarly, a second cylindrical space with a horizontal cross-section is defined by the plurality of blocking strips 1-4. The shoulders 1-5 can prevent the magnet bar 1-3 from entering the first cylindrical space defined by the plurality of shoulders 1-5 and moving towards the liquid outlet hole 7 of the kit 6 to avoid the magnet bar 1-3 blocking the liquid outlet hole 7. A gap is formed between adjacent blocking strips 1-4, and liquid reagents can flow in the spray hole 1-2 through the gap without being blocked by the magnet bar.

The nozzle includes an annular sleeve 2-1, an end plate 2-2 provided at one end of the annular sleeve 2-1, a nozzle pipe 2-3 provided at a center of the end plate 2-2, and a conical nozzle opening 2-4 provided at an end portion of the nozzle pipe 2-3. An annular blocking flange 2-5 surrounding a periphery of the nozzle pipe 2-3 is further provided at the end plate 2-2. A liquid channel 2-6 communicable with an interior of the annular sleeve 2-1 is formed in the nozzle pipe 2-3 and the conical nozzle opening 2-4. Namely, the liquid channel 2-6 penetrates through the end plate 2-2, the nozzle pipe 2-3 and the conical nozzle opening 2-4. An annular groove 2-7 is defined between the nozzle pipe 2-3 and the annular blocking flange 2-5.

The conical nozzle opening 2-4 of the nozzle is designed as a conical surface, which can prevent liquid from adhering to the lower end of the nozzle forming hanging droplets. The shape of the nozzle pipe 2-3 is conical frustum or cylindrical. The annular blocking flange 2-5 and annular groove 2-7 around the nozzle pipe 2-3 can prevent the slender nozzle pipe 2-3 from being damaged by external forces. The annular groove 2-7 can also clamp the sealing cover of a container when installing the container for receiving liquid reagents flowing out of the nozzle to prevent the sealing cover from being disengaged easily.

The annular sleeve 2-1 is in threaded connection with the spray pipe body 1-1. Specifically, the spray pipe body 1-1 is provided with a first end close to the plurality of shoulders 1-5, and an outer side wall of the first end is provided with an external thread 1-6, and an opening end of the annular sleeve 2-1 is provided with an internal thread 2-8 matching the external thread 1-6. As shown in FIG. 4, one end of the annular sleeve 2-1 is provided with the end plate 2-2, and the other end opposite to the end plate 2-2 is the opening end of the annular sleeve 2-1. The internal thread 2-8 provided in the inner side of the opening end are connected to the external thread 1-6 to fix the annular sleeve 2-1 and the spray pipe body 1-1.

The sealing valve is located in the annular sleeve 2-1. The specific structure of the sealing valve may be any one of the embodiment 1 to embodiment 3. The placement direction of the sealing valve is that the first bottom end of the frustum hole 3 is close to the spray pipe, and the second bottom end of the frustum hole 3 is close to the nozzle. The sealing valve body 1 of the sealing valve is in interference fit with the annular sleeve 2-1 to achieve sealing and prevent liquid from leaking out of the slot. The cylindrical valve hole 2 connects the spray hole 1-2 of the spray pipe to the liquid channel 2-6 of the nozzle. There is no shoulder at the connection end of the spray pipe body 1-1 and the sealing valve, and the magnet bar 1-3 can touch pressure the sealing valve. The sealing valve is made of a silica gel material, and has elasticity. After being squeezed by the magnet bar 1-3, the cylindrical valve hole 2 is blocked to achieve the sealing effect, thereby blocking liquid reagents from entering the nozzle, and achieving the effect of stopping liquid outlet.

When there is a sealing groove 5 in the sealing valve, the connection between the sealing groove 5 and the top end of the sealing valve body 1 is transited via an arc surface to guide the magnet bar 1-3 into the sealing groove 5. The cylindrical valve hole 2 is arranged at the center of the sealing groove 5, which facilitates the alignment and positioning of the magnet bar 1-3 and the cylindrical valve hole 2, and avoids liquid leakage caused by the magnet bar 1-3 deviating from the cylindrical valve hole 2.

When there is a cylindrical liquid storage tank 4 in the sealing valve, the cylindrical liquid storage tank 4 can store a portion of liquid reagents that is used for soaking the nozzle and preventing the liquid reagents inside the conical nozzle opening 2-4 from rapidly evaporating and crystallizing to block the nozzle.

The shape of the magnet bar 1-3 is cylindrical. The number of the plurality of blocking strips 1-4 is at least three, and the plurality of blocking strips 1-4 are uniformly distributed on the inner wall of the spray hole 1-2. The number of the plurality of blocking strips 1-4 is six as shown in FIG. 4. Too few blocking strips 1-4 (e.g., one or two) may cause the magnet bar 1-3 to stick to the inner wall of the spray hole 1-2 during movement, while too many blocking strips 1-4 may make the gap between two adjacent blocking strips too narrow, both of which may increase the flow resistance of liquid reagent. The number of the blocking strips 1-4 needs to be reasonably adjusted according to the sizes of the spray pipe body 1-1 and the magnet bar 1-3.

In order to achieve the movement of the magnet bar 1-3 in the spray hole 1-2, an electromagnet may be sleeved at the liquid inlet end of the spray pipe body 1-1, and a permanent magnet ring sleeved at the annular connecting part 1-7 of the spray pipe body 1-1. The polarity of the permanent magnet ring is opposite to that of the magnet bar 1-3, and the magnet bar 1-3 are attracted to block the nozzle leading to liquid outlet stopping. When discharging liquid, the electromagnet is electrified. The magnetic force of the electromagnet is greater than that of the permanent magnet ring, and the magnet bar 1-3 is attracted to the liquid inlet end of the spray pipe body 1-1. The plurality of shoulders 1-5 are contacted with the magnet bar 1-3, and the liquid reagent enters the nozzle through the gap for discharging.

Embodiment 5

Figure 5:
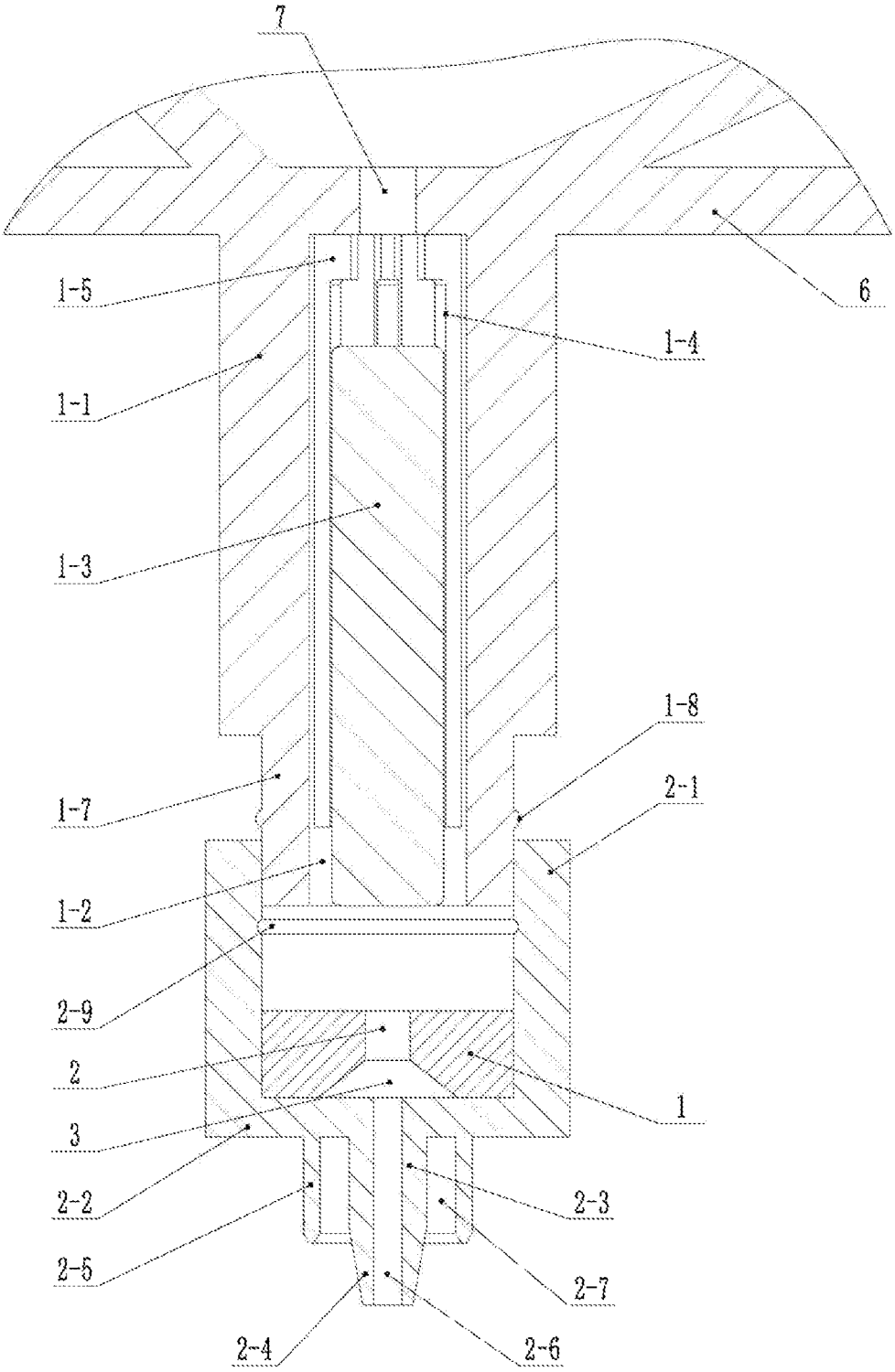
FIG. 5 is a schematic sectional view of the liquid outlet structure in embodiment 5.

The liquid outlet structure provided in embodiment 5 differs from embodiment 4 in that: in embodiment 5 as shown in FIG. 5, the annular sleeve 2-1 is in clamped connection with the spray pipe body 1-1. Specifically, the spray pipe body 1-1 is provided with a second end away from the plurality of shoulders 1-5, and the second end is provided with an annular connecting part 1-7. An outer side wall of the annular connecting part 1-7 is provided with an annular convex 1-8, and an opening end of the annular sleeve 2-1 is provided with an annular concave 2-9 matching the annular convex 1-8. The nozzle cooperates with the annular convex 1-8 of the spray pipe body 1-1, and the annular connecting part 1-7 is inserted into the annular sleeve 2-1, which is conducive to easy installation and not easy to disengage. The liquid reagent passes through the liquid outlet hole 7 of the kit, the spray pipe, and the cylindrical valve hole 2 of the sealing valve for outflowing from the liquid channel 2-6 in the nozzle.

The above-mentioned embodiments are only preferred embodiments of the disclosure, but not to limit the disclosure. However, any modification, equivalent replacement, improvement made within the spirit and principle of the present application should be included within the protection scope of the present application.

Moreover, the scope of the present disclosure is not intended to be limited to the particular embodiments described here. As one of ordinary skill in the art will readily appreciate from the disclosure of the present disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed is:

1. A liquid outlet structure, comprising: a spray pipe and a nozzle provided at an end portion of the spray pipe;

wherein the spray pipe comprises a spray pipe body, a spray hole formed in an axial direction of the spray pipe body, and a magnet bar provided in the spray hole; a plurality of blocking strips extending axially along the spray hole are uniformly arranged on an inner wall of the spray hole, and one end of each of the plurality of blocking strips is provided with a shoulder that extends towards a center of the spray hole; and the magnet bar is movable along an axial direction of the spray hole in a space defined by a plurality of shoulders of the plurality of blocking strips and the plurality of blocking strips;

wherein the nozzle comprises an annular sleeve, an end plate provided at one end of the annular sleeve, a nozzle pipe provided at a center of the end plate, and a conical nozzle opening provided at an end portion of the nozzle pipe; an annular blocking flange surrounding a periphery of the nozzle pipe is further provided at the end plate; a liquid channel communicable with an interior of the annular sleeve is formed in the nozzle pipe and the conical nozzle opening; and an annular groove is defined between the nozzle pipe and the annular blocking flange; and wherein the annular sleeve is in threaded connection or clamped connection with the spray pipe body; and a sealing valve is provided in the annular sleeve; a sealing valve body is provided with a cylindrical valve hole; wherein a bottom end of the cylindrical valve hole is provided with a frustum hole that is arranged coaxially with the cylindrical valve hole, and a first bottom end of the frustum hole is in communication with the bottom end of the cylindrical valve hole.

2. The liquid outlet structure according to claim 1, wherein the sealing valve further comprises a cylindrical liquid storage tank communicable with a second bottom end of the frustum hole; the cylindrical liquid storage tank is arranged coaxially with the frustum hole, and a diameter of the cylindrical liquid storage tank is greater than a diameter of the second bottom end of the frustum hole; and the diameter of the second bottom end of the frustum hole is greater than that of the first bottom end of the frustum hole.

3. The liquid outlet structure according to claim 2, wherein the sealing valve further comprises a sealing groove provided at a top end of the cylindrical valve hole, and a connection between the sealing groove and a top end of the sealing valve body is transited via an arc surface.

4. The liquid outlet structure according to claim 1, wherein the sealing valve further comprises a sealing groove provided at a top end of the cylindrical valve hole, and a connection between the sealing groove and a top end of the sealing valve body is transited via an arc surface.

5. The liquid outlet structure according to claim 1, wherein a shape of the sealing valve body is cylindrical.

6. The liquid outlet structure according to claim 1, wherein a shape of the magnet bar is cylindrical.

7. The liquid outlet structure according to claim 1, wherein the spray pipe body is provided with a first end close to the plurality of shoulders, and an outer side wall of the first end is provided with an external thread, and an opening end of the annular sleeve is provided with an internal thread matching the external thread.

8. The liquid outlet structure according to claim 7, wherein a shape of the magnet bar is cylindrical.

9. The liquid outlet structure according to claim 1, wherein the spray pipe body is provided with a second end away from the plurality of shoulders, and the second end is provided with an annular connecting part; an outer side wall of the annular connecting part is provided with an annular convex, and an opening end of the annular sleeve is provided with an annular concave matching the annular convex.

10. The liquid outlet structure according to claim 9, wherein a shape of the magnet bar is cylindrical.

11. The liquid outlet structure according to claim 1, wherein a quantity of the plurality of blocking strips is at least three.

12. The liquid outlet structure according to claim 11, wherein a circular section diameter defined by the plurality of shoulders is smaller than a section diameter of the magnet bar, and a circular section diameter defined by the plurality of blocking strips is greater than the section diameter of the magnet bar.

* * * * *